United States Patent [19]

Kowalczyk

[11] Patent Number: 4,944,104

[45] Date of Patent: Jul. 31, 1990

[54] DETACHABLE SNOW PLOW ASSEMBLY

[76] Inventor: Dennis Kowalczyk, 7712 Princeton Pl., Middleburg Heights, Ohio 44130

[21] Appl. No.: 219,057

[22] Filed: Jul. 13, 1988

[51] Int. Cl.[5] ..... E01H 5/04

[52] U.S. Cl. ..... 37/231; 37/279

[58] Field of Search ..... 37/279, 271, 270, 266, 37/287, 272, 277, 263, 214, 218, 232, 233, 234; 172/811, 816, 817

[56] References Cited

U.S. PATENT DOCUMENTS

| | | | |
|---|---|---|---|
| 1,142,677 | 6/1915 | Darois | 37/218 |
| 1,195,271 | 8/1916 | Ruth . | |
| 1,805,933 | 5/1931 | Victor | 37/263 |
| 2,188,805 | 1/1940 | Borgeson . | |
| 2,231,875 | 2/1941 | Behnke et al. | 37/272 |
| 2,460,348 | 2/1949 | Henry | 37/266 |
| 2,468,950 | 5/1949 | Wiedman . | |
| 2,582,136 | 1/1952 | Koblas | 37/263 |
| 2,716,572 | 8/1955 | Soucy . | |
| 2,722,064 | 11/1955 | Jaffe et al. | 37/270 |
| 2,920,187 | 1/1960 | Barilla . | |
| 3,349,507 | 10/1967 | Payne . | |
| 3,466,766 | 9/1969 | Kahlbacher . | |
| 3,588,147 | 6/1971 | Enters . | |
| 3,605,906 | 9/1971 | Coates . | |
| 3,659,363 | 5/1972 | Snyder . | |
| 3,987,562 | 10/1976 | Deen et al. . | |
| 4,024,653 | 5/1977 | Morris . | |
| 4,187,624 | 2/1980 | Blau . | |
| 4,450,635 | 5/1984 | Shwayder | 37/271 |

FOREIGN PATENT DOCUMENTS

| | | | |
|---|---|---|---|
| EP96200 | 5/1982 | European Pat. Off. . | |
| 3334121 | 4/1984 | Fed. Rep. of Germany | 37/266 |
| 3319233 | 7/1984 | Fed. Rep. of Germany | 37/266 |
| 3331460 | 7/1985 | Fed. Rep. of Germany | 37/232 |
| 412634 | 9/1945 | France . | |
| 2099892 | 12/1982 | United Kingdom . | |

OTHER PUBLICATIONS

Popular Mechancis, Dec. 1971, pp. 166–190 "Clear Your Drive the Easy Way".

*Primary Examiner*—Eugene H. Eickholt
*Attorney, Agent, or Firm*—Renner, Otto, Boisselle & Sklar

[57] ABSTRACT

A snow plow blade attachment for a vehicle which has a hood and a bumper. The blade is mounted on two vertically extending supports. The vertical supports, in turn, are each secured to horizontal arms which extend over the vehicle hood. At the distal end of the horizontal arms suction cups are provided to resiliently attach the horizontal arms and in turn the vertical supports and the blade to the vehicle hood. The vehicle bumper releasably engages the rear of the vertical supports to push the supports and thus the blade in order to plow snow.

21 Claims, 7 Drawing Sheets

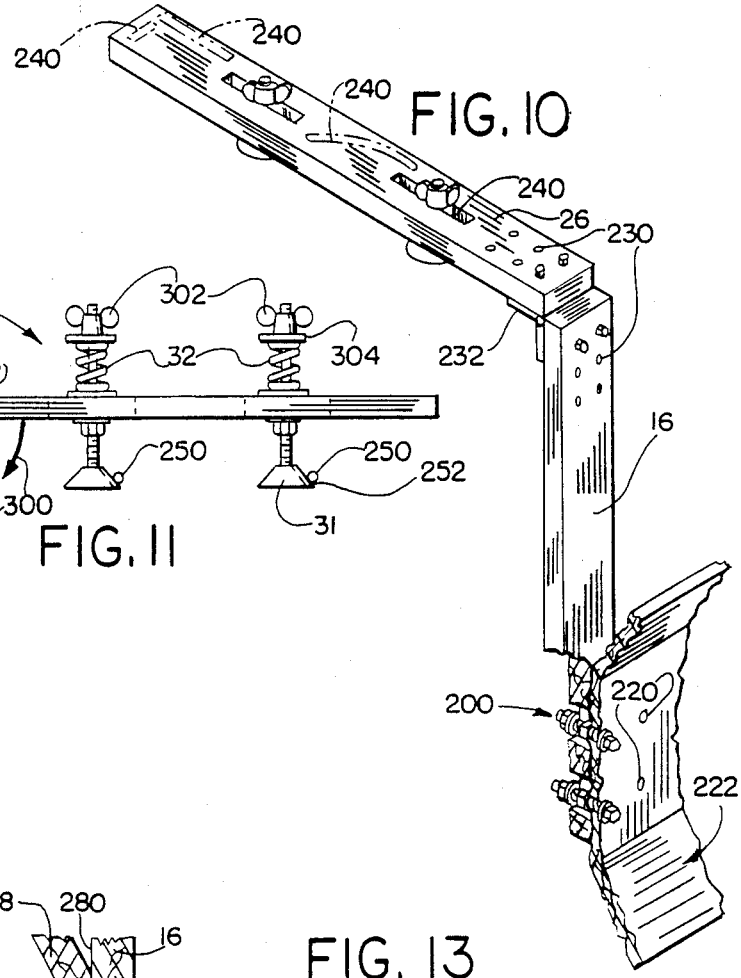
FIG. 10
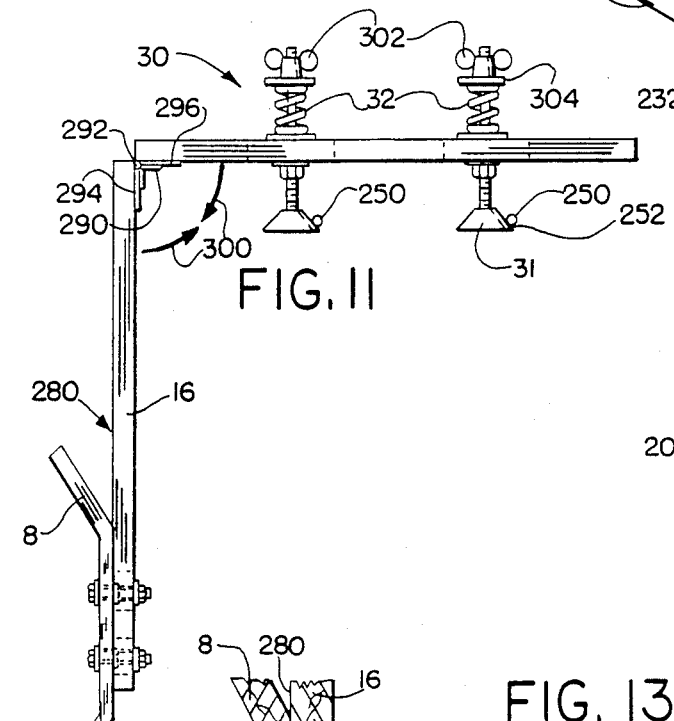
FIG. 11
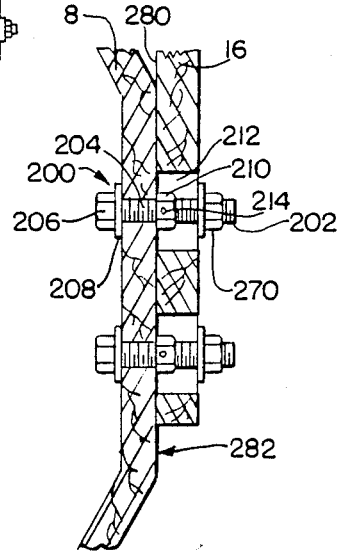
FIG. 12
FIG. 13
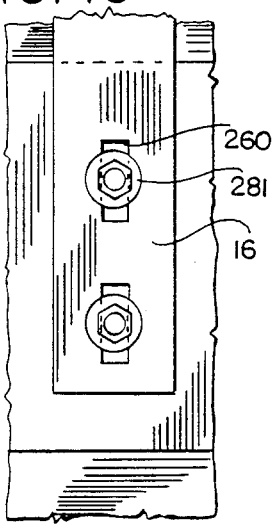

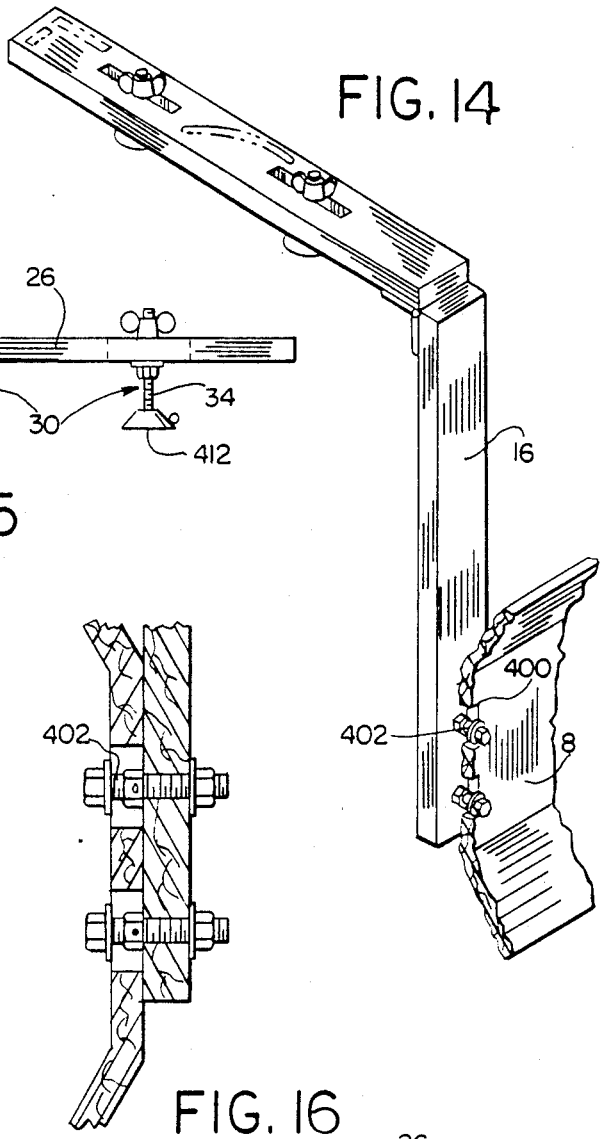
FIG. 14
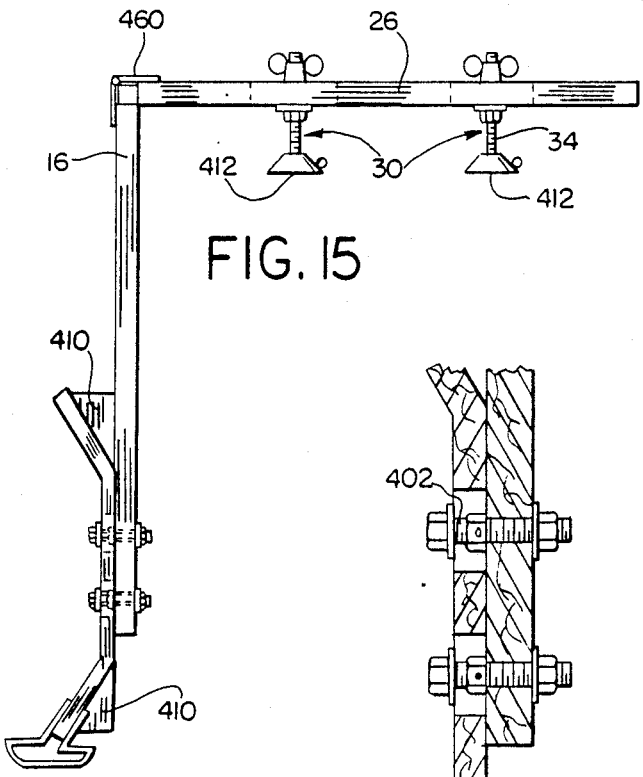
FIG. 15
FIG. 16
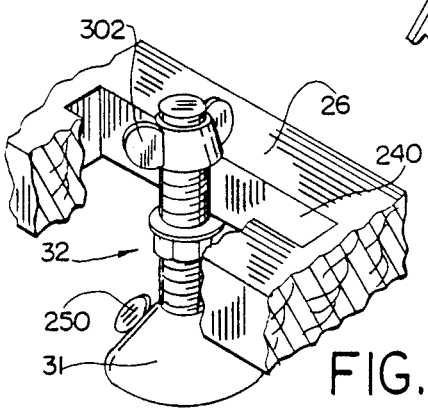
FIG. 17
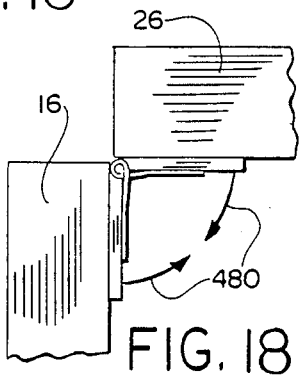
FIG. 18

DETACHABLE SNOW PLOW ASSEMBLY

BACKGROUND OF THE INVENTION

1. Field of the Invention

The present invention relates, generally, to the field of detachable snow plow blades for motor vehicles. It relates in particular to those blades that are designed for use in conjunction with vehicles a home owner might typically drive. Thus, the field most directly related to the invention encompasses those snow plow blades which are fairly lightweight, may be readily attached and detached from a vehicle and may be readily stored when not in use.

2. Description of the Background Art

Snow plow blades which are designed for attachment and removal from a vehicle are of course well known in the art. Generally, however, these blades are attached to a vehicle through a complicated series of chains and bolt and nut connections as well as bumper gripping and frame gripping devices. They are difficult to both install and remove. Some previous plow blades were designed to be lifted from the ground to clear objects and snow piles while others were more or less stationary with respect to the vehicle that was pushing the plow.

The prior art has disclosed folding snow plow blades and skids on the lower portion of the blade. Some of the plows are triangular in plan view and do not fold. In other applications blades have been more or less simply tied to bumpers of automobiles.

There has been disclosed in the use of resilient pads between a bumper and a snow plow although in the art an effort has been made to prevent direct contact between the bumper and the rear of the snow plow blade or its integral supports.

Suction cups have been used with respect to automobiles to mount small items such as windshield and headlight filters and even Kewpie TM dolls. They have not been used to mount snow plow blades.

SUMMARY OF THE INVENTION

It is a primary object of this invention to provide an improved snow plow blade and attachment apparatus in which the blade may have bearing on the bumper of a vehicle and further in which the principal attachment means of the blade assembly to the vehicle are suction cups.

It is an object of the invention to provide a means for readily and easily detachably securing the assembly to the hood of the vehicle. The invention contemplates a means by which a horizontal extension of the assembly overlies the hood of a vehicle and is substantially urged toward the vehicle hood for attachment. The horizontal extension, or arms, may be provided with slots or other means to vary the location and angle of the suction cups relative to the arms in order to accommodate different bumper extensions and heights as well as various hood configurations.

Provision, further, has been made to permit the snow plow blade to ride up and down on vertical support members so that irregularities in the ground and in the snow cover may be accommodated. Shock absorbing means are provided between vertical supports of the snow plow blade and the bumper of a vehicle. It is also envisioned that shock encountered by the blade will be transmitted principally to the front bumper of the vehicle pushing the plow. A lesser degree of the shock encountered by the blade will be absorbed through the vertical members and horizontal extensions of such vertical members. The horizontal members include secondary shock absorbing means attaching the horizontal members, through suction cup means, to the hood of the vehicle.

The blade is linearly reciprocal of the vertical members on which it is mounted. The blade is further provided with lugs that are designed to ride in tracks, slots, or the like, in the vertical members for up and down movement relative thereto. The vertical and horizontal members are pivotally mounted to each other and include hinge means interposed therebetween.

It is also envisioned that the hinge be spring loaded or otherwise biased so that the horizontal and vertical members, although configured at approximately 90° to each other, are urged toward each other and may be folded relative to each other.

It is contemplated that the blade be horizontally driven when in operating position and mounted on the vehicle. This is accomplished through the urging of a front bearing surface, or bumper, of the vehicle on which the apparatus is mounted.

Further, the blade in some applications, is sectionalized such that it may be geometrically reconfigured for easy storage upon its removal from the vehicle.

The foregoing and other features of the invention are hereinafter fully described and particularly pointed out in the claims. The following description and the annexed drawings set forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 10 is a perspective view, partially broken away, of one side of another embodiment of the invention;

FIG. 11 is a side view of the embodiment shown in FIG. 10;

FIG. 12 is a cut-away side view of the blade bolt attachment of FIGS. 10 and 11;

FIG. 13 is a partial back view of the blade bolt attachment of FIGS. 10–12;

FIG. 14 is a perspective view of another embodiment of the right side of the snow plow attachment, portions being broken away;

FIG. 15 is a side view of the embodiment of FIG. 14;

FIG. 16 is a cut-away side view of the blade bolt arrangement of the embodiment shown in FIGS. 14 and 15;

FIG. 17 is a fragmentary cut-away view of a horizontal arm suction cup assembly;

FIG. 18 is a fragmentary side view of a biased hinge usable between the vertical and horizontal arms of the invention;

DETAILED DESCRIPTION OF THE PREFERRED EMBODIMENTS

Figure 1:
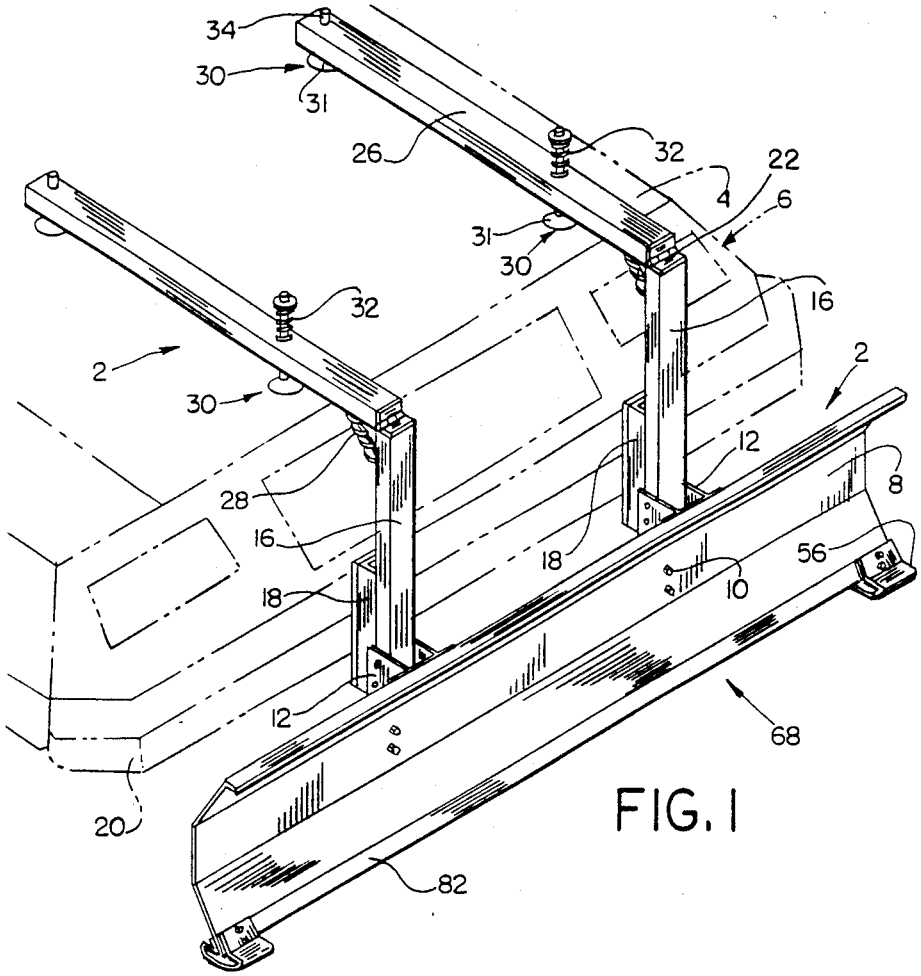
FIG. 1 is a perspective view of one embodiment of the snow plow assembly.
Figure 2:
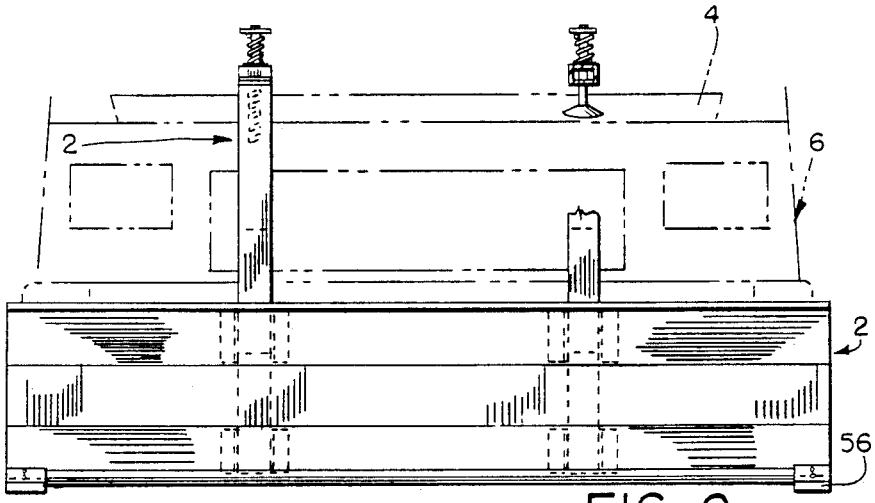
FIG. 2 is a front view of the snow plow of FIG. 1, parts being broken away for illustrative purposes.

Referring now with particularity to FIGS. 1–4, it is readily seen that the invention involves a snow plow attachment 2 which is designed to be secured to the hood 4 of a vehicle 6.

The snow plow assembly or attachment is comprised of a blade 8 which is secured by attachment members 10 to a blade holding structure 12. The blade attachment members 10 may be virtually any suitable fastener which enables the blade 8 to be secured to blade holding structure 12. Simple nuts and bolts are economical and quite useful for this purpose.

Structure 12 is secured to vertical support member 16. The back side of vertical element 16 is provided with a bumper pad 18 which is designed to releasably contact the bumper 20 of a vehicle. The upper ends of arms 16 are fitted with hinges 22 which connect the vertical arms 16 with horizontal arms 26. Interposed between the vertical and horizontal arms is a spring 28 which is designed to bias the vertical arms and in turn the blade toward the front of the vehicle.

The horizontal arms 26 extend rearwardly of the vehicle atop the hood 4. The horizontal arms 26 are secured to the hood by a suction cup assembly 30.

In the embodiment shown in FIGS. 1–4 the forwardmost suction cup assemblies are provided with a spring or biasing member 32 which exerts downward pressure on the horizontal arm 26 and in turn the vertical structure 16 and the blade 8. The spring serves to help absorb up and down reciprocal type movement of the blade as it travels over the surface of the ground in plowing snow. It thus serves to absorb shock and assists in accommodating irregularities in the surface being plowed.

The rearward suction cup assemblies 30 pivot slightly but are secured by a post 34 through the horizontal arm 26.

It will be appreciated that the use of suction cups to secure the snow plow assembly to the vehicle allows the snow plow assembly to be readily and quite easily attached and detached from the car, truck or van on which it is being used.

The suction cups that are envisioned to be employed with applicant's invention are of a fairly heavy duty nature so that they might readily accommodate not only upward forces exerted on them, but also the slight shear force that might be exerted on them when the apparatus is being used to plow snow.

Figure 3:
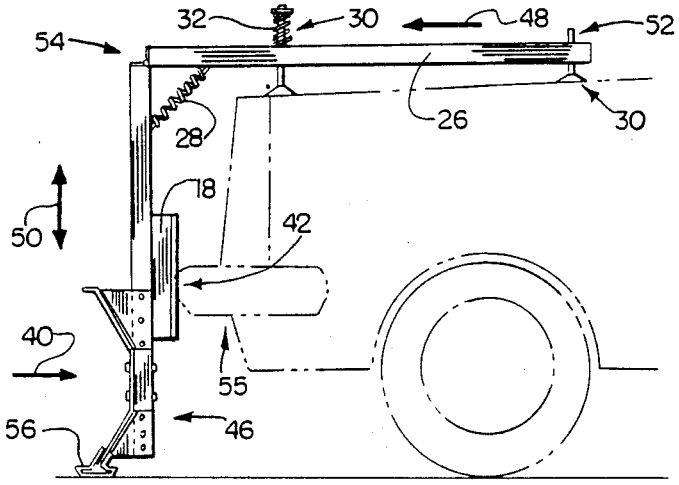
FIG. 3 is a side view of the snow plow assembly of FIG. 1.
Figure 4:
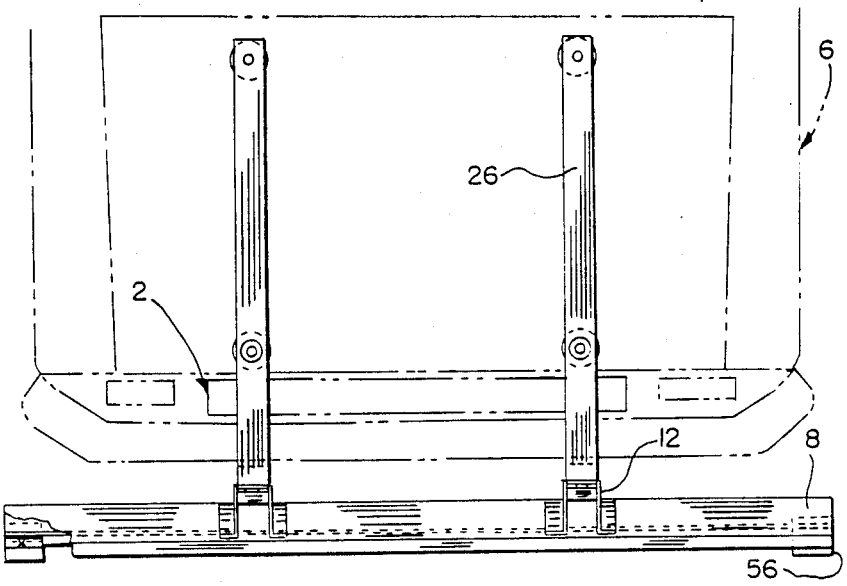
FIG. 4 is a top view of the snow plow assembly of FIG. 1.

From a conceptual standpoint, and referring with particularity to FIG. 3, it can be seen that a force will be exerted against the blade in the direction of arrow 40 when snow is being plowed. This force in turn acts about bumper fulcrum point 42 at which most of the force is absorbed due to the propinquity of the bumper to the lower portion 46 of the blade. However, it can be appreciated that some force is transmitted to the horizontal arm 26 in the direction of arrow 48. The suction cups are of a size sufficient to accommodate the small shear type force being exerted on them.

As the blade 8 reciprocates relative to the ground in the direction of arrow 50, spring 32 accommodates most of this movement. It can be seen that reciprocating movement of the snow plow assembly is accommodated at the distal or rearward end of horizontal arm 26 through a pivot point located generally in the area of 52 which is the rearward suction cup mounting structure.

The hinged connection, indicated generally as area 54, in combination with the spring biasing element 28, acts to keep the bumper pad 18 in substantially constant contact with the front portion 55 of the vehicle. This allows the front portion of the vehicle to absorb the shock of snow plowing and also perform the work of pushing the blade in a forward direction when it acts through the bumper pad and vertical member in translating forward force to the snow plow blade itself. Thus minimal rearwardly directed forces are translated and/or transferred to the horizontal arm 26 or in turn the attachment assemblies 30.

Thus, the suction cups employed in applicant's invention serve a stabilizing function as well as function in a manner to orient the horizontal and vertical members of the snow plow attachment relative to the vehicle.

The snow plow attachment has been provided with skids 56 so that the blade may more readily travel across the ground and snow cover on the ground. A suitable skid or ski 56 is shown in a proportionally enlarged side view in FIG. 5.

Suction cups of the type employed by applicant are detailed somewhat further on in the specification, however they are of the type that are normally supplied with a handle or release mechanism near the edge of the suction cup itself in order to enable a user of the suction cup to readily break the suction force by lifting a corner or edge of the suction cup. Various type clamping and lever cam arrangements can be utilized with respect to suction cup assemblies falling within the scope of applicant's invention. Massive assemblies of this type may be found in the art relating to apparatus for carrying huge sheets of glass. However, it is generally not necessary to employ a structure of such massiveness because of unique arrangement of the parts of applicant's invention which minimize the shear and vertical forces translated to the suction cup surfaces. It is understood by those skilled in the art that a suction cup generally is most effective in resisting pressure directed at 90° to the plane of the suction surface. It is less effective in resisting force directed in a plane parallel to the suction surface. A readily available item which accommodates this latter type force is a Velcro TM type fastener. This type fastener could be employed to attach the horizontal arm but it has a disadvantage of having to have one portion of the Velcro fastener secured to the hood or top portion of the vehicle thus marring the finish. Further, the fastener portion of the Velcro attachment which was exposed to the weather would in all likelihood become clogged with ice and snow thus further reducing its efficiency for attachment of a second half which might be secured to the horizontal arm of a snow plow attachment structure.

The inventor of the instant invention has found suction cups to be surprisingly suitable for performing the function required of them in securely mounting and stabilizing a snow plow assembly on a vehicle.

Figure 5:
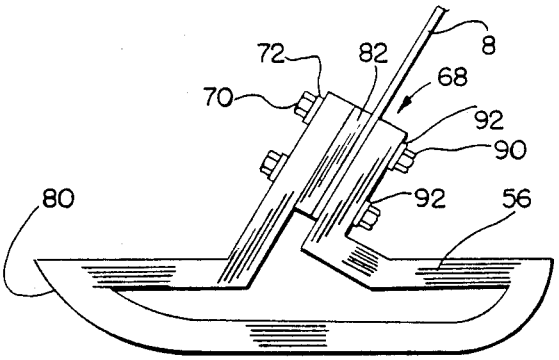
FIG. 5 is a side view, proportionally enlarged, of a ski employable on the snow plow assembly.
Figure 6:
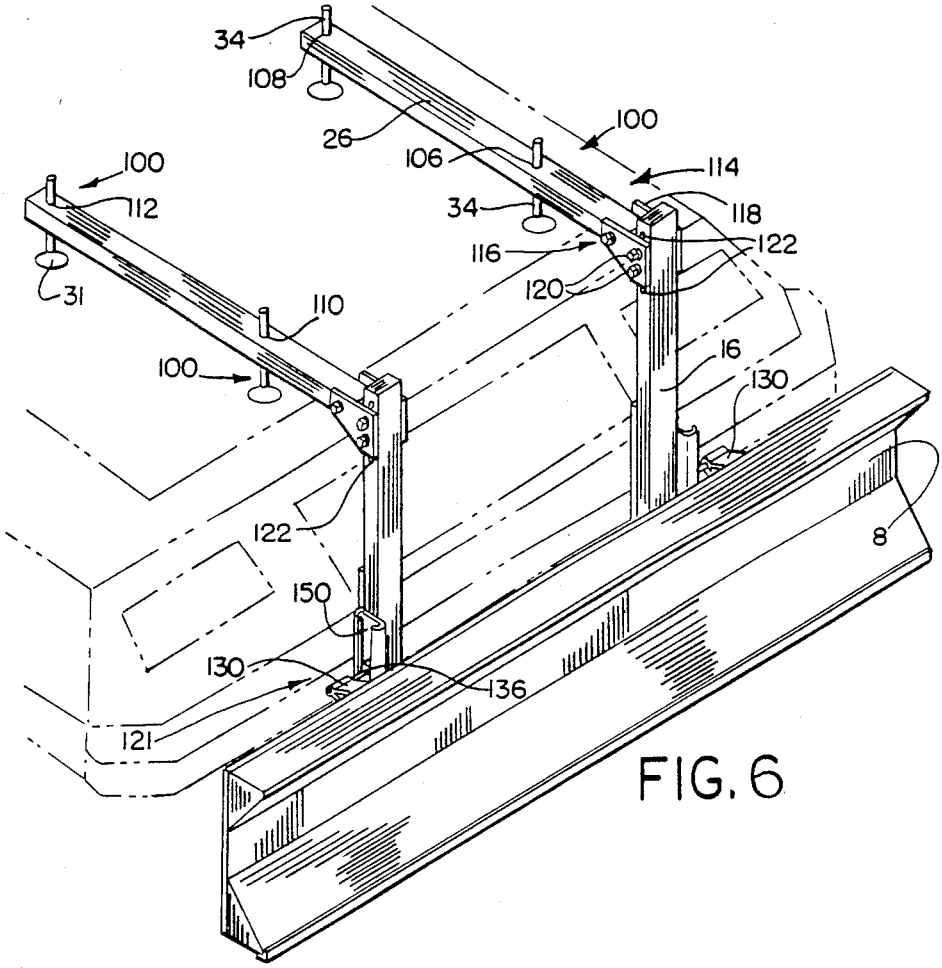
FIG. 6 is a perspective view of an alternative embodiment of the snow plow assembly.
Figure 7:
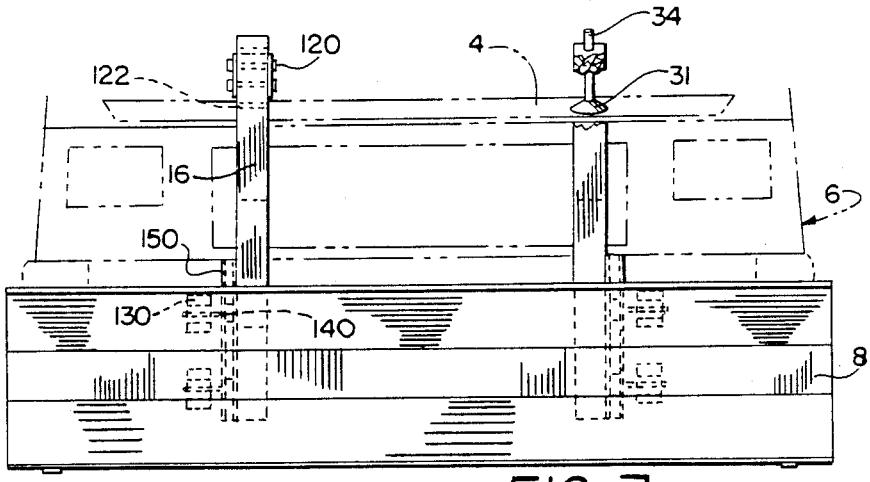
FIG. 7 is a front view of the embodiment of FIG. 6, portions of the vertical being broken away.
Figure 8:
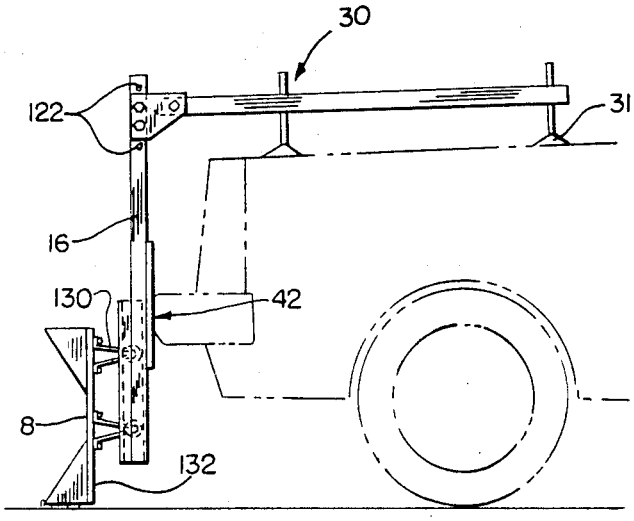
FIG. 8 is a side view of the embodiment of FIG. 6.
Figure 9:
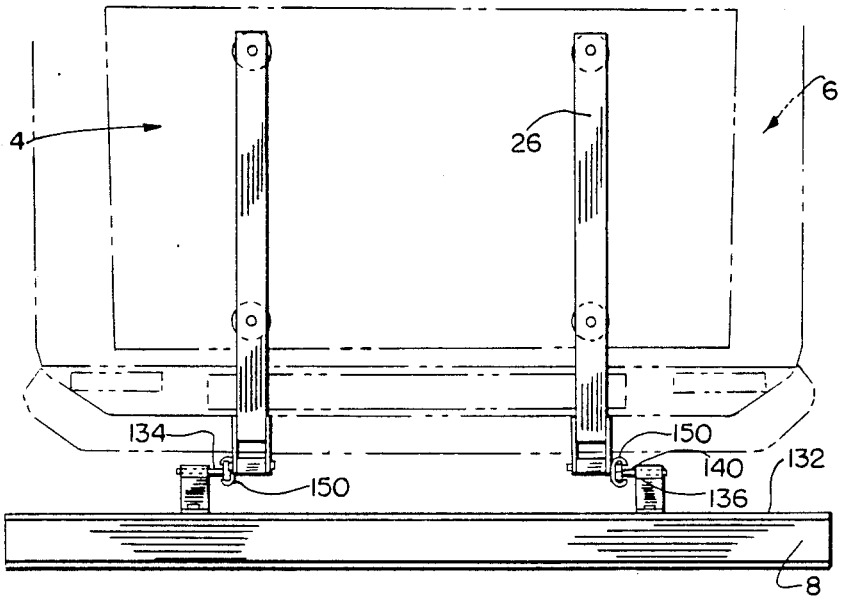
FIG. 9 is a top view of the embodiment of FIG. 6.

With respect now in particularity to FIG. 5, the applicant has provided for the employment of a ski structure 56 at the bottom portion 68 of the blade 8. The ski is attached with bolts 70 backed by washers 72 which pass through apertures (not shown) in the lower portion 68 of the blade 8. The skis may be suitably made of a non-wearing material and serve to protect the lower portion of the blade as well as transmitting the ground forces to the upper portions of the snow plow assembly.

The skis are suitably curved at 80 to assist in riding over obstacles that are encountered when plowing snow. The skis are designed to be replaceable when they wear out.

A nosing portion 82 has been provided on the blade to assist in reducing wear and absorbing wear which is encountered for the most part in that location of the snow plow attachment blade structure. This however is an optional feature.

The bolts 70 pass through the nosing 82 in addition to the blade 8 when the nosing is employed. The bolts, of course, are secured at their rearward ends by nuts 90 after passing through suitable washers 92. The nuts may be of the self-locking type or alternatively the washers 92 may be lock washers.

With reference now with particularility to FIGS. 6–9, an alternative embodiment of the invention is shown. In this embodiment an alternative suction cup arrangement has been employed and is seen generally in area 100. In this embodiment the suction cups 31 are quite simply attached to vertical rods 34 which are secured at points 106, 108, 110 and 112 to the horizontal arms 26. The forward end 114 of horizontal arms 26 is pivoted about point 116 on the attachment structure 118. It will be seen from FIG. 6 that the attachment structure 118 may be moved upwardly or downwardly along the vertical element 16 by merely changing the positioning of bolts 120 in the vertical shaft. In other words they may be located in spaced apertures 122 provided in the vertical arm. This arrangment allows for accommodating different vehicle heights in order to adjust the blade relative to the ground while still securing the horizontal portions of the snow plow attachment suitably to the pushing vehicle. Other arrangements for accommodating different vehicle front end and hood shapes will be further and subsequently explained with respect to still further embodiments of the invention.

With reference still to FIGS. 6–9, the structure 121 for attaching the blade 8 to the vertical member 16 is configured differently than in the embodiments previously described. In the embodiment shown in FIGS. 6–9 a generally A-shaped pin retainer 130 is secured to the back 132 of the blade 8. The A-shaped pin retainer is designed to accommodate a roller pin 134 which carries on its inner end 136 a roller 140. Those familiar with the garage door art will appreciate that this is substantially similar to structures employed for easing the up and down reciprocal movement of a garage door. The roller, which may be a ball bearing type structure or any suitable roller, is designed to be captured in tracks 150 which are secured to the verticals 16.

When the invention is used for plowing snow the blade may thus ride up and down relative to the ground, the vehicle and the rest of the snow plow assembly. It can be seen that in this embodiment also, the major force is absorbed at the front portion of the vehicle in the area of bumper point 42.

The adaptability of the snow plow assembly is such that it may be secured to vehicles having other than generally horizontal hoods as is shown in the phantom line drawings. In other words, a hood which is generally vertical, such as is found on some vans that are used by the motoring public, can be used to push the snow plow assembly. The horizontal arm is simply pivoted to a substantially vertical position to accommodate the hood or front end attachment point of the pushing vehicle. The bulk of the weight of the apparatus is supported, for the most part, by the ground itself.

FIGS. 10–13 represent a combination of improvements which is preferred to be incorporated in a detachable snow plow blade assembly. FIG. 10 shows the right side arms of the snow plow assembly. Portions of the lower, or vertical, arm have been broken away for clarity. Portions of the blade also have been broken away and fragmentized since it will be appreciated that a corresponding left side member and complete blade will be employed in utilizing the invention.

In the structure shown in FIGS. 10–13 the blade is designed to be secured to or have provided thereon a lug 200. In the illustrations this lug takes the form of a through bolt 202 which passes through aperture 204 in the blade. Lying behind the bolt head 206 is a suitable washer 208. Lock nut 210 is snugged against the back 212 of the blade. The type of nut shown has a detent 214 in one of the wrench pads of the nut. The transference of this deformation in the side of the nut to the threads interior of the nut cause it to lock securely on the bolt on which it is placed. Any suitable locking type structure could be employed along bolt 202 in order to secure the blade to the bolt. It will be noted that the bolts may be located through a plurality of apertures 220 that are provided along the face 222 of the blade. These apertures also are optional and are provided to accommodate lateral or horizontal adjustment of the vertical and horizontal arms of the apparatus so that the apparatus may be ajdusted to fit different vehicles. In this regard it should be noted also that the vertical arm 16 as well as the horizontal arm 26 have also been provided with a multiplicity or plurality of apertures 230 to accommodate locating the hinge 232 in a variety of positions relative to both the vertical and horizontal arms.

Further to accommodate differing vehicle front end and hood and bumper structures there has been provided in the horizontal arm 26 a plurality of openings 240 (shown in phantom lines). The suction cup structures can be placed through any of these apertures so that they may be properly positioned on the hood of a plowing vehicle.

In FIG. 11 the suction cup attachment structure 30 has been shown employing a biasing or spring member 32 in both the forward and rearward positions. Although this type of arrangement is generally not necessary, it further accommodates moveement of the snow plow and its attachment assembly to the vehicle through the suction cups 31. It will be noted that in the embodiment shown in FIG. 11 rings 250 are shown at the periphery 252 of the suction mechanism. These rings may be employed to easily release the suction and in turn release the snow plow assembly from the vehicle.

The assembly is thus removably secured at the suction cup points and the front end of the vehicle (in the embodiment shown a bumper) provides a mechanism by which the plow and verticals may be releasably engaged for pushing snow. The assembly itself however is not attached to the vehicle except at the suction cup points.

The blade in the FIGS. 10–13 embodiment is free to ride up and down in slots 260 formed in vertical member 16. The blade lugs or bosses are mounted for reciproca movement through the aperture or slot 260 for reciprocal movement relative to the vertical arms and are therefore movabley secured to the vertical arm through the employment of nut 270 which is also preferably a lock nut. Thus, there is provided relative sliding movement between the blade 8 and the vertical member 16. For this purpose, in the embodiment shown, a washer 281 has also been provided to overlie the solid portions of the vertical extensions 16. This tends to spread wear about a larger surface on the back side of the vertical. It should be noted that this wear is additionally minimized by the fact that most of the wear pressure is exerted between the wear faces 280 and 282 of the vertical and the snow plow blade back respectively.

The spring 290 in this embodiment is intermediate the vertical and the extension (which in this case is again shown as being horizontal) of the vertical portion of the attachment assembly. Biasing member 290 is simply a coiled spring member. The spring membrr 290 is secured about hinge pin 292 and contacts hinge leaves 294 and 296 and urges them toward each other in the direction of arrow 300 best seen in FIG. 11. This arrangement tends to keep the back of the blade, be it through the vertical support or a bumper pad as previously explained, in contact with the front portion or bumper portion of the pushing vehicle. As was previously alluded to, this also serves to ensure that the lion's share of the force encountered by the blade when plowing snow is transmitted to the vehicle at the front of the vehicle as opposed to being transmitted through the apparatus to the suction cup faces.

Thus in the embodiment shown in FIGS. 10–13 a readily adjustable apparatus has been described. Note that the apparatus attachment points on the apparatus itself are quite easily reconfigured. For instance the invention has employed wing nuts 302 overlying washers 304 which serve as retainers for the spring or biasing mechanism 32. This facilitates repositioning of the suction cup means or apparatus 30 at different points on a vehicle hood. Thus the flat sheet metal or smooth fiberglass portions of the vehicle may be utilized to detachably secure the snow plow apparatus.

Referring now to FIGS. 14–16 a still further embodiment of the invention is shown. In this embodiment the blade 8 itself is provided with slotted portions 400. The blade may be detachably secured by using a threaded fastener 402. Although not shown in this embodiment it is possible to have a number of slots positioned in the blade for various different attachment points of the blade to the remainder of the assembly. These slots need not necessarily be a vertical arrangement but could be formed to accommodate movement of the blade relative to the vehicle in any direction. Thus side to side and diagonal type movement could be accommodated by merely employing a larger or differently shaped aperture in the blade. It should be kept in mind that suitable structures such as washers should be employed to accommodate this sliding type movement of the blade relative to the vertical support member. In this arrangement the up and down movement of the blade tends to assist in cleaning the slots which may become clogged with ice and snow. This is unlike the embodiment previously described with respect to FIGS. 10–13 in which the slotted portions are protected from direct contact with ice and snow by the blade itself. Although, in that previously described embodiment (FIGS. 10–13) an anti-clogging feature is also exhibited by the movement of the blade reciprocally of the vertical structure thus cleansing the blade attachment accommodating aperture in the vertical member.

Referring again with particularity to FIGS. 14–16 it will be seen that a support or stiffening structure 410 has been provided on the back portion of the blade. This support structure further bears on the forward facing portion of the vertical 16 for sliding movement therealong. This structrure is not shown in FIG. 14 although the essential attachment structures of the embodiment shown in FIGS. 14–16 are the same. In this embodiment of the shock absorbing spring mechanisms are not shown as being part of the suction attachment means 30. Due to the nature of a suction cup they are inherently somewhat flexible to force being exerted on them through a vertical extension member such as 34. The longer member 34 is, and the further the attachment of horizontal arm 26 is from the suction cup, the greater is the relative movement that can be accommodated between the horizontal arm and the suction cup surface 412.

In FIG. 15, hinge 460, interconnecting the horizontal and vertical supports, has been placed on the outside of the structue. This is merely a variation of the type of hinge placement that is employable. It provides a different direction in which the arms may be folded relative to one another.

If the vertical portion of the assembly were built of a solid piece as opposed to two vertical members, the hinge employed could also be a piano-type hinge traversing the entire length of the jucture of the vertical and horizontal members, or any portion thereof, as is desired. A single piece structure or any of a variation of criss-crosses or generally vertically extending apparatus may be employed to support the blade. The inventor however has found it best and most economical to use the structure that he has shown in this specification. The same may be said relative to a multiplicity of horizontal structures, i.e. there may be one or a number of horizontal structures depending on their lateral expanse and overall configuration. The device of course could be customized for particular vehicles in which the configuration of the vehicle was known in advance. The suction cup feature of the invention is thus readily adaptable to accommodate a variety of structure.

With reference to FIG. 18, a spring structure is shown in a somewhat more enlarged view. The spring exerts pressure on the vertical 16 and horizontal 26 urging them together in the direction of arrows 480. The spring is suitably secured to the leaves of the hinge by welding, screws or any other suitable fastener. It may also be integral.

Figure 19:
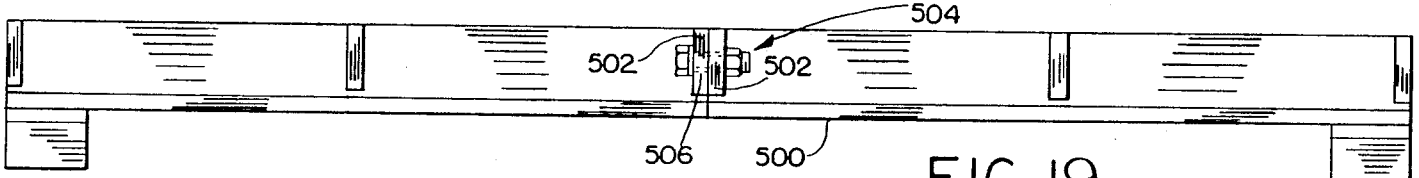
FIG. 19 is a top view of one type of blade arrangement usable in the invention.
Figure 20:
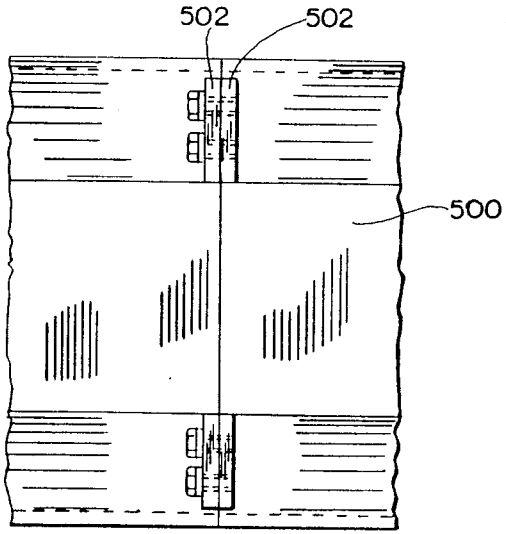
FIG. 20 is a fragmentary back view showing an interconnection between two portions comprising the snow plow blade usable with some embodiments of the invention.

In FIGS. 19 and 20 a blade is shown which is capable of being broken into a multiplicity of parts. The multiple sections of the blade (500 in this case) are secured through ribs 502 with fasteners 504 which extend through apertures 506 in the ribs. The blade may be geometrically reconfigured to be easily stored when removed from the vehicle. In the illustration of FIG. 19 the blade is shown as being formed of two parts. This of course may be expanded to any number of parts that best suit the builder of the invention. Note that the illustration in FIG. 20 shows bolts that merely secure into threaded portions of one of the ribs so that no nut is necessary on the bolt. This really though is a matter of choice.

In the embodiments of the invention that have been shown and described, the front of the vehicle is the bearing surface which contacts a corresponding bearing surface on the back of the vertical portions of the snow plow attachment. The vehicle bearing surface thus provides the forward impetus to the snow plow blade and serves to absorb the majority of the force confronted by the snow plow. The blade is adapted for vertical reciprocal movement of the ground and the vehicle through a variety of apparatus which may include tracks, slots, elongate suction cup attachment shafts, and the like.

The support structure for the blade is usable for a variety of structures and need not necessarily be employed only with a snow plow since the suction means attachment feature of the invention is readily adaptable. The accessories which are supported by the lower end of the vertical attachment structure may be provided with rollers, slots, lugs or other structure to accommodate lateral or reciprocal movement which best suits the accessory being utilized. Alternatively, the various embodiments described relative to direct accessory attachment may be employed with vehicle attachment structures which do not employ a suction cup attachment arrangement; although, the inventor has found a suction cup attachment most suitable for detachably securing the assembly to a vehicle.

It is within the scope of this invention that the lower support structure (the verticals) and the upper support structure (the horizontals) may have a variety of configurations in order to provide a mounting means for accessories. Accessories, but preferably snow plow blades, are readily accommodated by mounting on the lower portion of the support structure and a means for removably adhering the upper portion of the structure has been provided. In the embodiment of choice, a pair of blade attachment assemblies is employed which extend generally symmetrically from the blade. Each of the assemblies includes an upright arm and either a continuation of that arm or an additional arm that runs generally horizontally thereof. The upright arm is engageable by the vehicle bumper and the generally horizontal extensions of the arm are provided with means for adjustably and detachably securing the horizontal extensions to the hood of a vehicle. The means most readily employed are suctions cups to secure the horizontal members. The suction cups are generally and most desirably mounted for movement relative to the horizontal extensions. There has further been provided shock absorber means interposed between the blade and the vehicle. In one of the embodiments a track means is employed for accommodating generally vertical reciprocal movement of the blade relative to the track and the attachment point of the track.

The snow plow blade is most readily used with a vehicle having both a hood and a bumper. The blade attachment assembly extends from the blade and the assembly is engageable and urged forward by the vehicle bumper. The method of detachably securing the assembly to the hood is most preferably a suction type assembly. The method by which the apparatus is detachably secured to the hood preferably includes a method by which the horizontal members may be urged generally continually toward the hood. The blade itself is preferably mounted on the vertical extensions of the apparatus for vertical displacement relative to the hood of the vehicle. The blade is generally mounted transverse of the vertically extending members and the horizontal members generally extend rearwardly from the vertical members. The blade and its attachment mechanism to the vertical members is preferably linearly reciprocal of the vertical attachment member.

The horizontal members are preferably urged at a point between the distal attachment section of the horizontal member and the hinged end of the horizontal member by a spring biasing mechanism. The horizontal member may move relative to the attachment point of the apparatus to the vehicle in a limited fashion. The assembly itself is driven forwardly principally by the urging of the front bearing surface of the pushing vehicle. The pushing force being translated generally through the vertical member, or the bearing surface behind the vertical member, to the blade to provide horizontal driving motion through such urging. Upon backing, the hinges allow the blade to swing away from the front bumper against the force of the hinge spring such that shocks are absorbed.

The preferred structure comprises the substantially mirror image right and left sides in which substantially parallel alignment of the two sides is maintained. Horizontal members are supported respectively by vertical members and the whole assembly is releasably secured to the vehicle.

Having thus fully described my invention, modifications may occur to those skilled in the art which modifications are intended to be included within the scope of this invention.

I claim:

1. In combination with a snow plow blade and a vehicle having a hood and a bumper, the improvement comprising a pair of blade attachment assemblies generally symmetrically extending from the blade, each of the assemblies including an upright arm engageable by the vehicle bumper, each upright arm having a generally horizontal extension and means for detachably securing said horizontal extension to the hood.

2. The combination of claim 1, wherein said means for detachably securing includes suction cup means.

3. The combination of claim 2, wherein said suction cup means is mounted for movement relative to said horizontal extension.

4. The combination of claim 3, wherein shock absorber means are interposed between the blade and the vehicle.

5. The combination of claim 2, further including track means for accommodating generally vertical reciprocal movement of the blade relative thereto.

6. A snow plow blade in combination with a vehicle having a hood and a bumper, the improvement comprising a blade attachment assembly extending from the blade, the assembly being engageable by the vehicle bumper, and means for detachably securing the assembly to the hood wherein said means for detachably securing includes suction means.

7. The apparatus of claim 6 wherein said means for detachably securing further includes means for urging said assembly toward said hood.

8. The apparatus of claim 6, said snow plow blade being mounted on said assembly for vertical displacement relative to the hood.

9. A snow plow attachment for a vehicle having a hood, said attachment comprising:

a blade, a vertically extending member, said blade being supported by and transverse of said vertically extending member, a horizontal member extending rearwardly from said vertically extending member, said horizontal member including means for securing the snow plow attachment to the hood of the vehicle, said means for securing including suction means.

10. The attachment of claim 9 further including hinge means interposed between said vertical and horizontal members.

11. The snow plow attachment of claim 9, said horizontal member having a hinged end for mounting on said vertical member and a distal end for reciprocally receiving said suction means.

12. The snow plow attachment of claim 9 wherein said suction means is secured to said horizontal member for limited movement relative thereto.

13. The attachment of claim 10 wherein said hinge means is biased.

14. A snow plow attachment for a vehicle having a hood, said attachment comprising:

a blade, a vertically extending member, said blade being supported by and transverse of said vertically extending member, a horizontal member extending rearwardly from said vertically extending member, said horizontal member including means for securing the snow plow attachment to the hood of the vehicle, wherein said blade is linearly reciprocal of said vertical member.

15. The attachment of claim 14, said blade having generally horizontally extending lugs extending toward said vertical member, said lugs being reciprocally received in vertically extending slots defined by said vertical member to thereby accommodate vertical movement of the blade relative to the vertical member and the ground.

16. A snow plow attachment for a vehicle having a hood, said attachment comprising:

a blade, a vertically extending member, said blade being supported by and transverse of said vertically extending member, a horizontal member extending rearwardly from said vertically extending member, said horizontal member including means for securing the snow plow attachment to the hood of the vehicle, wherein said horizontal member includes a distal end and further wherein said means for securing includes means for urging the distal end of said horizontal member toward said vehicle hood.

17. A snow plow attachment for a vehicle having a hood, said attachment comprising:

a blade, a vertically extending member, said blade being supported by and transverse of said vertically extending member, a horizontal member extending rearwardly from said vertically extending member, said horizontal member including means for securing the snow plow attachment to the hood of the vehicle, said vehicle further having a front bearing surface, said vertical member and said blade being horizontally driven through the urging of said bearing surface.

18. A snow plow attachment for a vehicle having a hood, said attachment comprising:

a blade, a vertically extending member, said blade being supported by and transverse of said vertically extending member, a horizontal member extending rearwardly from said vertically extending member, said horizontal member including means for securing the snow plow attachment to the hood of the vehicle, the attachment further having at least two vertical members spaced in substantially parallel alignment, at least two horizontally extending members, each of said horizontally extending members being supported, respectively, by a vertical member, said horizontally extending members being spaced in substantially parallel alignment with each other, said blade being mounted transverse of said vertical members; and said horizontal members being releasably secured to the vehicle hood.

19. The attachment of claim 18 wherein said horizontal members are adapted to carry suction means for releasably securing said horizontal members to said vehicle hood.

20. The attachment of claim 19, the horizontal members being pivotably attached to the vertical members.

21. The attachment of claim 20 further including biasing means for urging the blade toward the vehicle and said blade having skids.

* * * * *